US006026553A

United States Patent [19]

Brunelle

[11] Patent Number: 6,026,553

[45] Date of Patent: Feb. 22, 2000

[54] METHOD FOR STACKING RECEPTACLES

[75] Inventor: Steven J. Brunelle, Boise, Id.

[73] Assignee: Micron Electronics, Inc., Nampa, Id.

[21] Appl. No.: 09/073,134

[22] Filed: May 5, 1998

[51] Int. Cl.[7] ..... B65D 21/02; B65D 21/032

[52] U.S. Cl. ..... 29/428; 206/509; 206/511

[58] Field of Search ..... 206/503, 504, 206/507, 509, 511; 220/4.26, 4.27, 23.4; 29/428

[56] References Cited

U.S. PATENT DOCUMENTS

| | | | |
|---|---|---|---|
| 3,521,764 | 7/1970 | Loomis | 206/509 X |
| 3,584,757 | 6/1971 | Blaisdell | 220/4.26 |
| 4,109,789 | 8/1978 | Fattori et al. | 206/509 X |
| 4,144,968 | 3/1979 | Shelton | 220/366.1 X |
| 5,325,966 | 7/1994 | Chang | 220/4.24 X |
| 5,607,057 | 3/1997 | Eches et al. | 206/509 X |
| 5,649,638 | 7/1997 | Roy et al. | 206/509 X |

FOREIGN PATENT DOCUMENTS

| | | | |
|---|---|---|---|
| 3628-516 | 3/1998 | Germany . | |
| 402162 | 11/1933 | United Kingdom | 217/65 |
| 602433 | 5/1948 | United Kingdom | 220/23.4 |

*Primary Examiner*—Allan N. Shoap
*Assistant Examiner*—Joe Merek
*Attorney, Agent, or Firm*—Trop, Pruner, Hu & Miles, P.C.

[57] ABSTRACT

The invention, in one embodiment, is a method for stacking receptacles. The method comprises stacking a first receptacle on a second receptacle; and inverting the stacked first and second receptacles to engage the first and second receptacles.

11 Claims, 7 Drawing Sheets

METHOD FOR STACKING RECEPTACLES

This application is related to the co-pending U.S. patent application Ser. No. 09/072,899, filed on May 15, 1998 and entitled A Stackable Receptacle.

BACKGROUND OF THE INVENTION

1. Field of the Invention

This invention relates generally to a receptacle and, more particularly, to a method for stacking receptacles.

2. Description of the Related Art

Stackable receptacles are commonly used in many areas of industry. One such use is the handling of electronic components during their manufacture, shipment, and assembly into computers. For instance, when a personal computer manufacturer receives electronic components, the components may be tested before their assembly into personal computers. The tested components are then placed into receptacles called "trays." The trays are stacked as they are filled. Finally, stacks of trays are moved to transport the tested components to their destinations in the assembly facility.

These stacks of trays containing electronic components are frequently vulnerable to spillage. A stack may be unstable because individual trays do not mate well or are stacked too high. Also, a stack may be knocked over while colliding with another stack, a piece of machinery, or even a passing pedestrian. Stabilizing measures may be taken to help prevent spillage. For instance, a rubber band or a strap might be wrapped around the stack. However, rubber bands and straps may be difficult to apply and may be prone to breaking in some contexts.

Some stabilizing measures interlock the stacked trays to achieve greater stability. Exemplary interlocking, stabilized receptacles are disclosed, for instance, in U.S. Pat. Nos. 1,137,759; 2,561,561; 3,259,263; and 4,293,072. Each of these receptacles employs interlocking stabilizing measures that are difficult to use, or time-consuming, or both. For instance, U.S. Pat. No. 1,137,759 teaches stacking of folding boxes using U-shaped retaining clips along the bottom edges of the four sides of a box. The clips fall into position when stacking under the action of gravity to engage upper edge portions of the underlying box to interlock the boxes and prevent sliding movement. However, gravity will act to extend the clips before a box is actually stacked, thereby aggravating the difficulties in aligning the box for stacking.

The present invention is directed to overcoming, or at least reducing the effects of, one or more of the problems set forth above.

SUMMARY OF THE INVENTION

The invention, in one embodiment, is a method for stacking receptacles. The method comprises stacking a first receptacle on a second receptacle; and inverting the stacked first and second receptacles to engage the first and second receptacles.

BRIEF DESCRIPTION OF THE DRAWINGS

Other aspects of the invention will become apparent upon reading the following detailed description and upon reference to the drawings in which.

Figure 1:
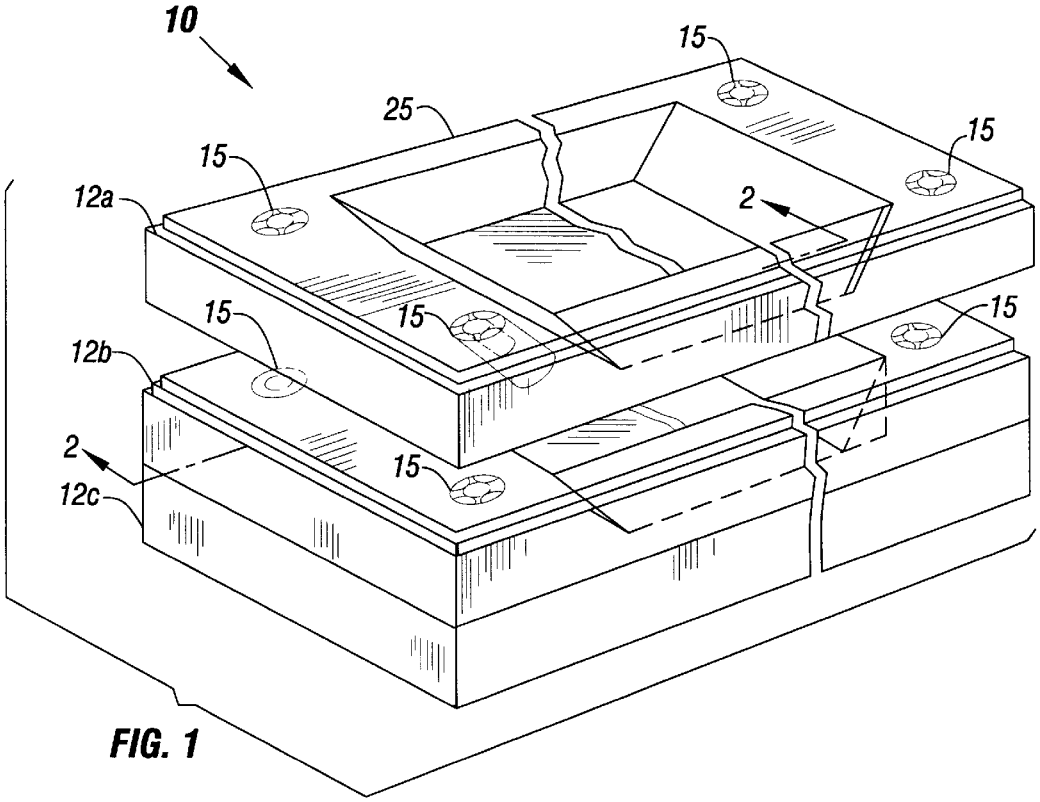
FIG. 1 illustrates one embodiment of an assembly of stackable receptacles in accord with the present invention in which the receptacles are shown unengaged.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

A First Embodiment of an Assembly of Stacked Receptacles

FIG. 1 illustrates one embodiment of an assembly 10 of stackable receptacles 12*a*–*c* in accord with the present invention. The assembly 10 in the embodiment of FIG. 1 comprises three receptacles 12*a*–*c*, but the number of receptacles is not material to the practice of the invention. The receptacle 12*a* is in the process of being placed on the receptacle 12*b* that was previously stacked on the receptacle 12*c*. None of the receptacles 12*a*–*c* is engaged with any other of the receptacles 12*a*–*c* in FIG. 1.

The embodiment of the assembly 10 illustrated in FIG. 1 actually includes four points 15 of engagement between each of the receptacles 12*a*–*c*. The precise number of engagement points 15 is implementation specific and may be more or fewer than four. Each engagement point 15 is constructed using the slot and engaging member combination illustrated in FIG. 2 and discussed more fully below. However, in embodiments having more than one engagement point 15, the engagement points 15 may have differing constructions.

Figure 2:
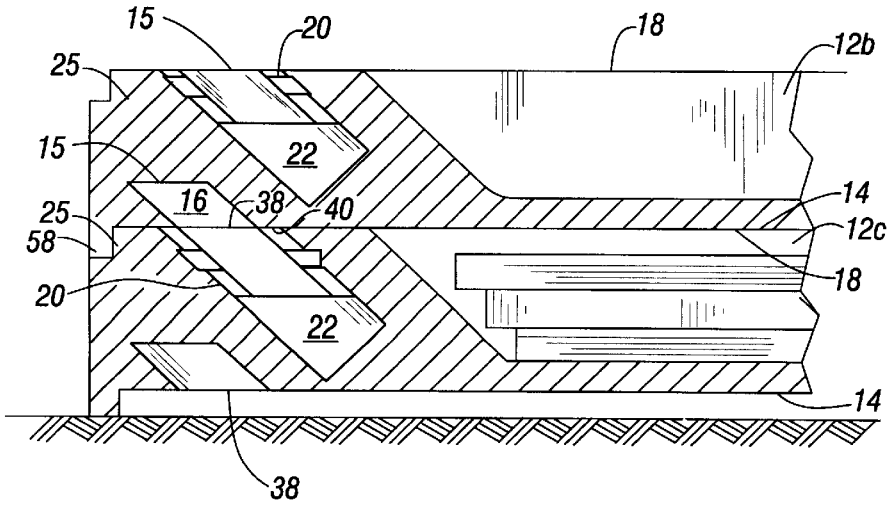
FIG. 2 is a partial cross-section of the assembly in FIG. 1 taken along the line 2—2 of FIG. 1.

FIG. 2 is a partial cross-section of the assembly 10 in FIG. 1 taken along the line 2—2 of FIG. 1. More particularly, FIG. 2 illustrates the relationship of the stacked receptacles 12*b*–*c* in cross-section. The receptacle 12*b* includes a first side 14 with a first slot 16 therein. The receptacle 12*c* includes a second side 18 with a second slot 20 therein. An engaging member 22 reciprocates within the second slot 20 to extend therefrom into the first slot 16 responsive to gravity to engage the receptacle 12*b* and the receptacle 12*c* as discussed in more detail below.

Figure 3A:
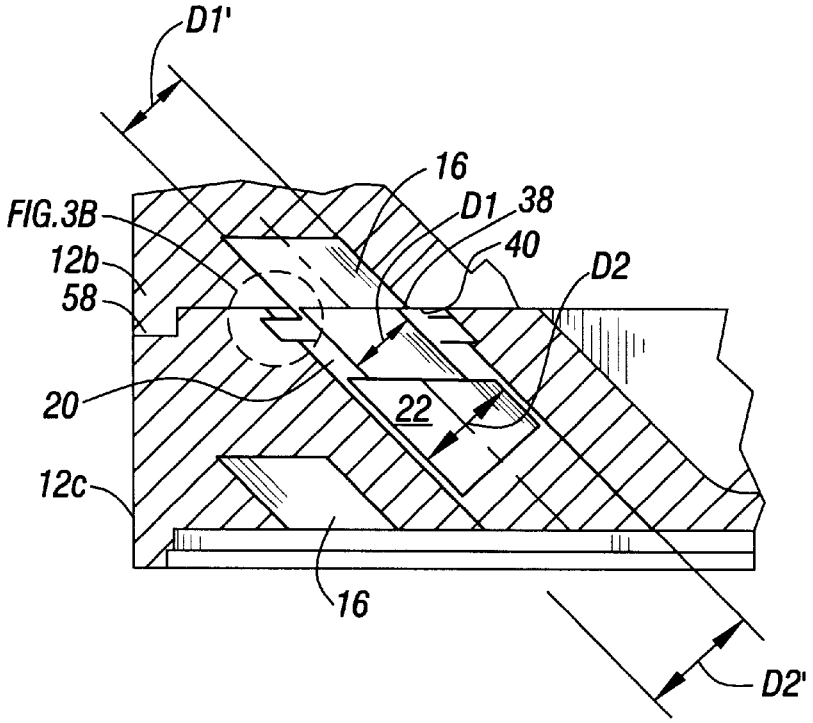
FIGS. 3A–3B are partial cross-sections of the assembly in FIG. 1 illustrating the principles of engagement between the two receptacles in the embodiment illustrated therein.

Referring now to both FIGS. 1 and 2, the receptacles 12*a–c* in the particular embodiment illustrated are modular although this is not necessary to the practice of the invention. Each of the receptacles 12*a–c* has the same construction and is interchangeable with the others. More particularly each of the receptacles includes a body 25 having a first surface 14 and a second surface 18. The first surface 14 includes the first slot 16 obliquely disposed relative thereto. The second surface 18 includes the second slot 20 obliquely disposed relative thereto in parallel relation to the first slot 16, the opening 40 of the second slot 20 being vertically aligned with the opening 38 of the first slot 16 as best shown in FIG. 3A. As mentioned above, the engaging member 22 reciprocates within the second slot 20.

In the particular embodiment illustrated, the first and second receptacles 12*a* and 12*b* include numerous characteristics that may be varied in alternative embodiments. More particularly:

- both the first surface 14 and the second surface 18 are quadrilaterally shaped. However, virtually any geometric shape may be employed and the first surface 14 and the second surface 18 may differ in shape;
- both the first and second surfaces 14 and 18 are continuous. In other embodiments, either, or both, of the first and second surfaces 14 and 18 may be alternatively formed. For instance, the first and second surfaces may comprise the ends of legs in which the engagement points 15 may be formed.
- there are four engagement points 15, one in each corner of the quadrilaterally shaped surfaces 14 and 18. Alternative embodiments might employ only a pair of engagement points 15 that are horizontally displaced or placed in opposite corners.
- each body 25 is quadrilaterally shaped in horizontal cross-section although other geometric shapes may suffice and the body 25 of each receptacle 12*a–c* may differ from one or more of the others.
- the first surfaces 14 parallel the second surfaces 18. As those in the art having the benefit of this disclosure will appreciate, still other variations on the particular embodiment might be employed in alternative embodiments.

Figure 3B:
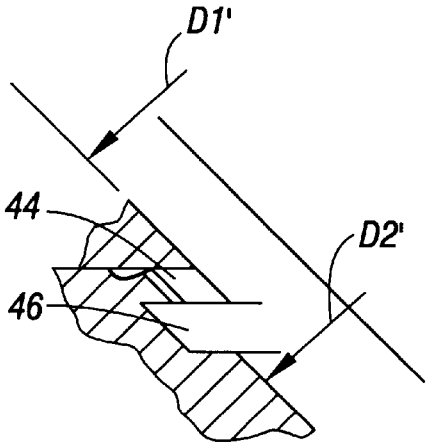
Figure 4:
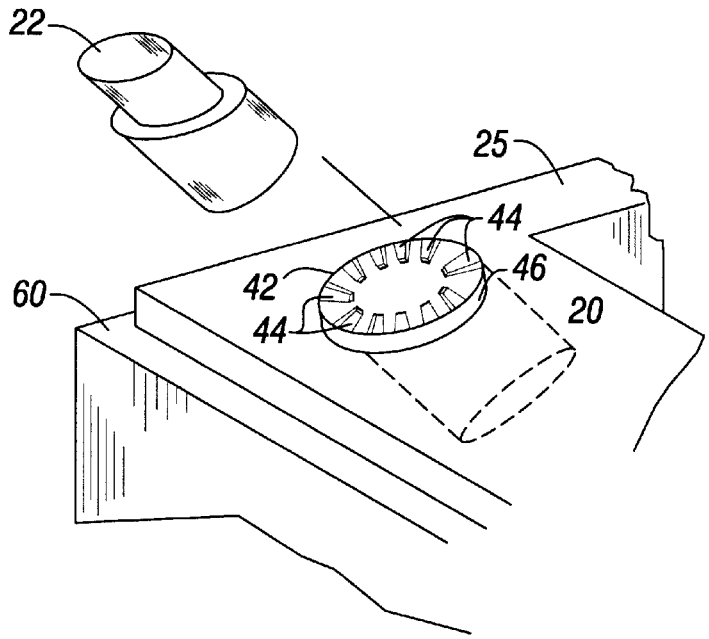
FIGS. 4–5 illustrate one embodiment of an engagement member such as might be employed in the assembly of FIG. 1.
Figure 5:
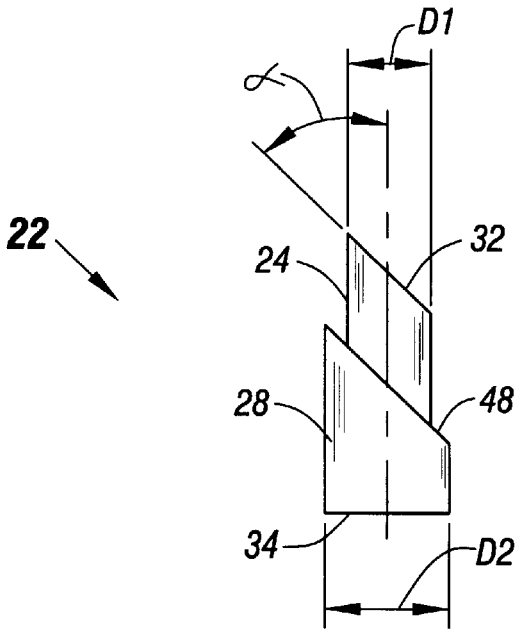

FIGS. 3A–3B and 4–5 illustrate the principles of engagement between the receptacle 12*b* and the receptacle 12*c* and the engagement points 15 in the embodiment of FIGS. 1–2. More particularly, FIGS. 3A–3B are fragmented views of the partial cross-section in FIG. 2. FIGS. 4–5 illustrate one embodiment of the engaging member 22 employed in the assembly 10 of FIG. 1.

The engaging member 22 is shown retracted into the slot 20 in FIG. 3A. As is apparent from FIGS. 4–5, the engaging member 22, in this particular embodiment, is a pin having a conical cross-section although this is not necessary to the practice of the invention. The engaging member 22, as shown best in FIG. 5, comprises a first part 24 having a first diameter $D_1$ and a second part 28 having a second diameter $D_2$ greater than the first diameter $D_1$. The engaging member 22 at one end 32 is angled and at the other end 34 is flat. The angle $\alpha$ of the end 32 is not material to the practice of the invention and the end 32 may by flat like the end 34 in some embodiments.

Returning to FIG. 3A, the slots 16 and 20 in the particular embodiment illustrated also have conical cross-sections as best shown in FIG. 4. The slots 16 and 20 are designed to accommodate the engaging member 22 without restricting its reciprocal movement. The slot 20 therefore has a diameter $D_2'$ slightly larger than the diameter $D_2$ and the slot 16 has a diameter $D_1'$ slightly larger than the diameter $D_1$. The openings 38 and 40 of the slots 16 and 20, respectively, therefore also align when the receptacles 14 and 16 are stacked as is shown in both FIG. 2 and FIG. 3A.

This particular embodiment also includes a means for retaining the engaging member 22 in the slot 20 to help prevent loss of the engaging member 22. The engaging means illustrated in FIG. 4 is a rosette 42 comprised of a plurality of flexible tabs 44. The slot 20 includes a cutout 46 shown best in FIG. 3B into which the tabs 44 are displaced when the engaging member 22 is forcibly inserted into the slot 20. When the engaging member 22 is extended as discussed more fully below, the shoulder 48 on the engaging member 22 defined by the differing diameters $D_1$ and $D_2$ will stop against the flexible tabs 44, thereby discouraging removal of the engaging member 22 from the slot 20. The design and construction of the rosette 42 is well known in the art.

As A Method of Stacking and Engaging the Receptacles

Returning to FIG. 1, the receptacles 12*a–c* are first stacked. In the embodiment illustrated, stacking includes not only placing the receptacles 12*a–c* one upon the other, but also first aligning them so that the lip 58, shown best in FIGS. 2 and 3A, of each receptacle mates with the shoulder 60, shown best in FIG. 4, of the receptacle on which it is placed. However, in some alternative embodiments, alignment may be unnecessary if the receptacles are in some manner self-aligning.

Once the receptacles 12*a–c* are stacked, they are inverted to engage the receptacles 12*a–c*. In the embodiment illustrated, the receptacles 12*a–c* have no lid or cover from the compartment to contain the contents. Thus, the receptacle 12*a* on the top of the stack is left empty and provides a lid for the receptacle 12*b*. The receptacle 12*b* likewise provides a lid for the receptacle 12*c*. In this manner, each receptacle provides a lid for the receptacle below it in the assembly 10. However, in embodiments in which the receptacles 12–12*c* have lids or covers, the top receptacle 12*a* may be filled.

Figure 6:
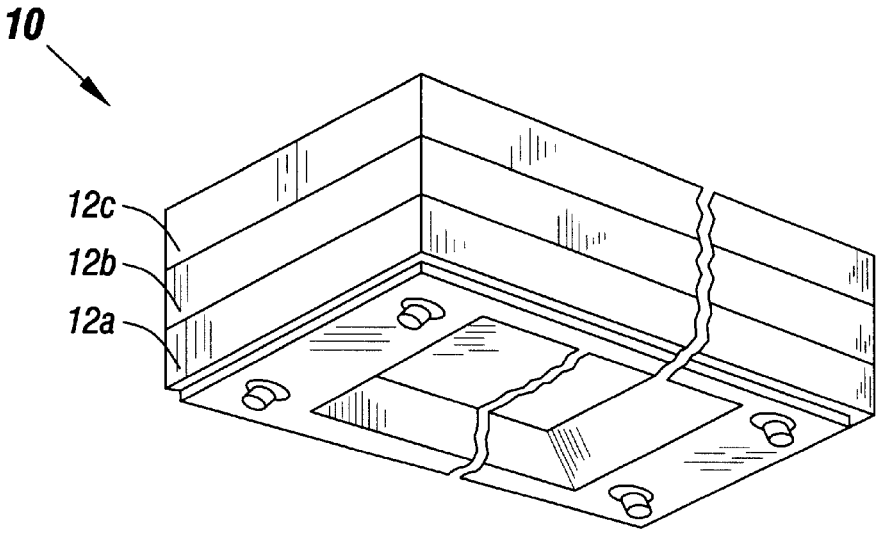
FIG. 6 illustrates the assembly of FIG. 1 with the receptacles engaged.
Figure 7:
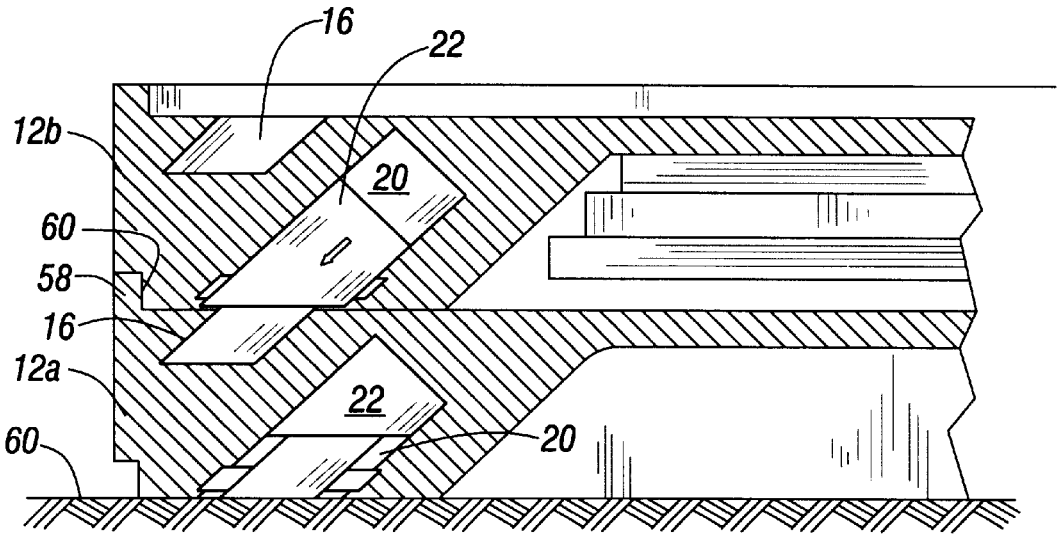
FIG. 7 is a partial cross-section of the assembly of FIGS. 1 and 8 with the receptacles engaged as shown in FIG. 6.

Inverting the stacked receptacles 12*a–c* engages the receptacles 12*a–c* as the engaging members 22 extend responsive to gravity as shown in FIGS. 6–7. As shown in FIG. 7, the engaging member 22 of the receptacle 12*a*, now on the bottom after inversion, retracts when the assembly 10 is placed on the surface 60. The engaging members 22 of the receptacles 12*b–c*, however, do not retract and maintain the engagement of the receptacles 12*a–c* to secure the assembly 10.

A Second Embodiment for an Engagement Point

Figure 8:
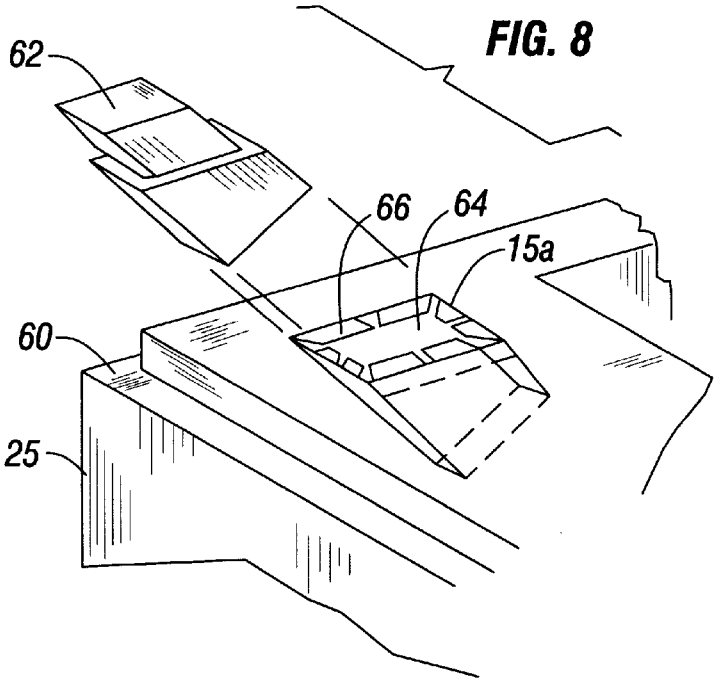
FIGS. 8–9 illustrate a second embodiment of an engagement point alternative to that in FIGS. 4–5.
Figure 9:
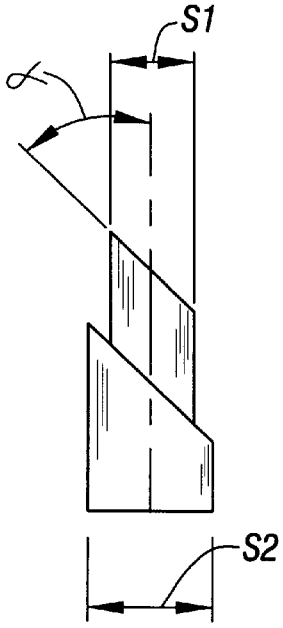
Figure 10:
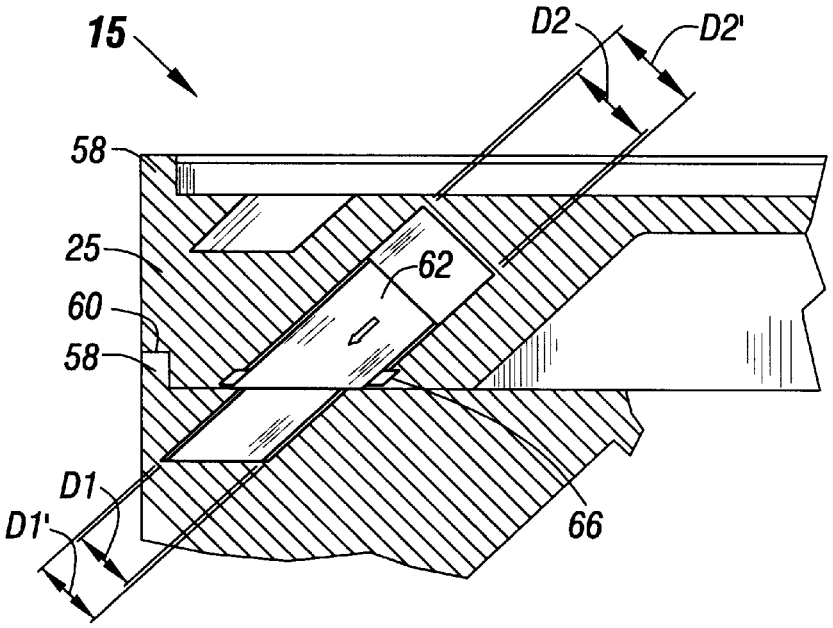
FIGS. 10–13 illustrate a third embodiment of an engagement point alternative to that in FIGS. 4–5 and 8–9.

FIGS. 8–10 illustrate a second embodiment 15*a* of an engagement point including engaging member 62 alternative to the engaging member 22 of FIGS. 4–5. This particular embodiment of the engaging member 62 is quadrilateral rather than conical in cross-section, but is otherwise designed and constructed as is the engaging member 22. The slot 64, being designed to accommodate the engaging member 62, is also quadrilateral in cross-section and includes a rosette 66. The rosette 66 is quadrilateral, but is otherwise designed and constructed like the rosette 42 in FIGS. 4–5. Although not shown, the mating receptacle will include a slot such as the slot 16 that is also quadrilateral in cross-section, but will be otherwise designed and constructed like the slot 16 in FIGS. 4–5.

A Third Embodiment for an Engagement Point

Figure 11:
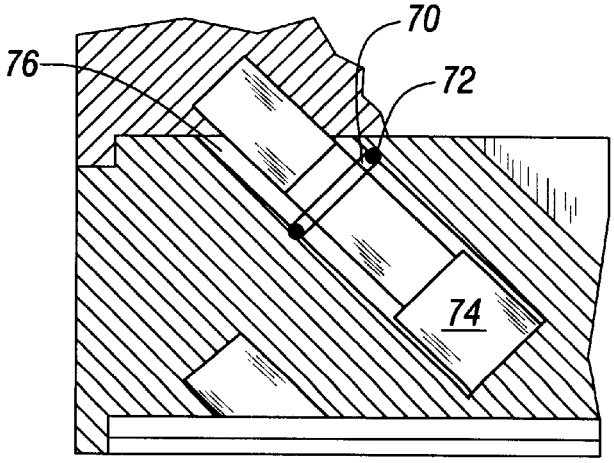
Figure 12:
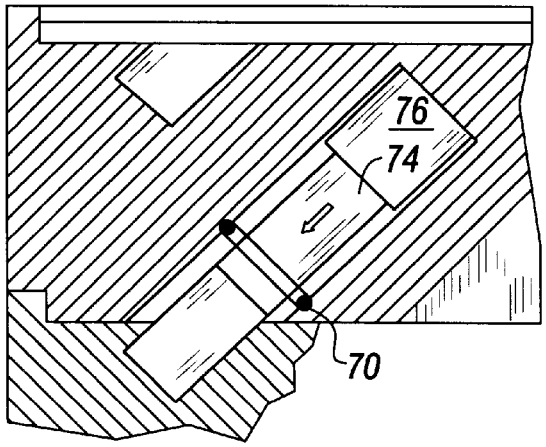
Figure 13:
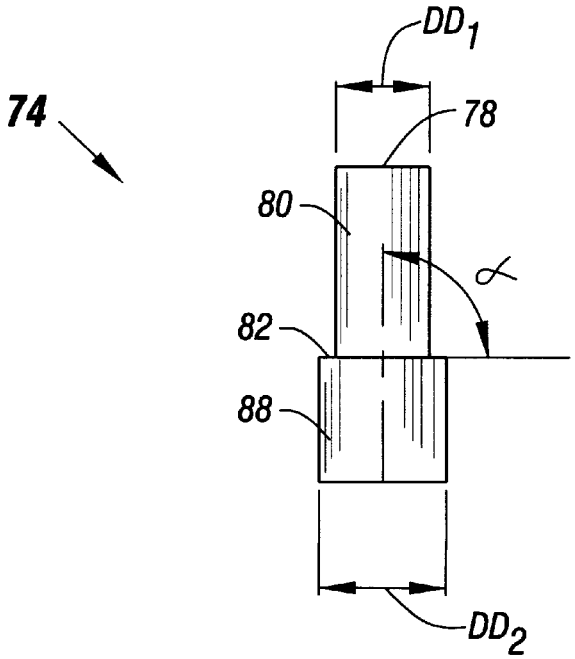

FIGS. 11–13 illustrate a third embodiment of an engagement point 15*b*. This particular embodiment is designed and constructed in the same manner as the embodiment of FIGS. 3A–5, except as noted. First, the retaining means of the embodiment in FIGS. 11–13 differs from that previously discussed. Instead of a rosette, the embodiment of FIGS. 11–13 includes a split, or C, ring 70 installed in a groove 72 that stops the extension of the engaging member 74. The split ring 70 is compressed enough to slide into the slot 76 over the first end 78 of the first part 80 of the engaging member 74. The split ring 70 is pushed down the first part 80 until it reaches the groove 72, whereupon it decompresses to install. Thereafter, the extension of the engaging member 74 is halted when the shoulder 82 defined by the difference in the first diameter $DD_1$ and the second diameter $DD_2$ of the first part 80 and the second part 88, respectively, contacts the split ring 70. Second, the first end 78 is flat rather than angled.

Remarks

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. For instance, it is contemplated that some features of the three embodiments described herein, including, but not limited to, the retaining means and rosettes, may be combined in alternative ways to create still other embodiments in light of this disclosure. It is therefore evident that the particular embodiments disclosed above may be altered or modified and all such variations are considered within the scope and spirit of the invention. Accordingly, the protection sought herein is as set forth in the claims below.

What is claimed:

1. A method for stacking receptacles, comprising:

stacking a first receptacle on a second receptacle; and inverting the stacked first and second receptacles together to extend an engaging member responsive to gravity from the second receptacle to engage a slot in the first receptacle, said slot being obliquely disposed to a surface of the first receptacle.

2. The method of claim 1, wherein stacking the first receptacle on the second receptacle includes aligning the first receptacle with the second receptacle.

3. The method of claim 2, wherein stacking the first receptacle on the second receptacle includes placing the aligned first receptacle on the second receptacle.

4. The method of claim 1, wherein stacking the first receptacle on the second receptacle includes placing the first receptacle on the second receptacle.

5. The method of claim 1, wherein inverting the stacked first and second receptacles includes manually inverting the stacked first and second receptacles.

6. The method of claim 1, wherein stacking the first receptacle on the second receptacle comprises vertically aligning the first receptacle with the second receptacle before placing the first receptacle on the second receptacle.

7. A method for stacking a first receptacle and a second receptacle, each of the first and second receptacles including (a) a body having a first surface and a second surface, wherein the first and second surfaces include a slot obliquely disposed relative thereto in parallel relation whose openings are vertically aligned, and (b) a pin reciprocal within the second slot, the method comprising:

stacking a first receptacle on a second receptacle; and inverting the stacked first and second receptacles together to extend the pin and engage the first and second receptacles.

8. The method of claim 7, wherein stacking the first receptacle on the second receptacle includes aligning the first receptacle with the second receptacle.

9. The method of claim 8, wherein stacking the first receptacle on the second receptacle includes placing the aligned first receptacle on the second receptacle.

10. The method of claim 7, wherein stacking the first receptacle on the second receptacle includes placing the first receptacle on the second receptacle.

11. The method of claim 7, wherein inverting the stacked first and second receptacles includes manually inverting the stacked first and second receptacles.

* * * * *